US007337561B2

(12) United States Patent
Potashnick

(10) Patent No.: US 7,337,561 B2
(45) Date of Patent: Mar. 4, 2008

(54) SHOE SOLE TRACTION-ENHANCING DEVICE

(76) Inventor: Robert I. Potashnick, P.O. Box 1772, Mercer Island, WA (US) 98040

( * ) Notice: Subject to any disclaimer, the term of this patent is extended or adjusted under 35 U.S.C. 154(b) by 428 days.

(21) Appl. No.: 11/165,547

(22) Filed: Jun. 22, 2005

(65) Prior Publication Data

US 2006/0011216 A1 Jan. 19, 2006

Related U.S. Application Data

(60) Provisional application No. 60/521,859, filed on Jul. 13, 2004.

(51) Int. Cl.
*A43B 23/28* (2006.01)

(52) U.S. Cl. ..... 36/59 R; 36/59 C; 12/142 R; 15/104

(58) Field of Classification Search ..... 36/59 R, 36/59 C; 12/142 R; 15/104.002, 161, 237
See application file for complete search history.

(56) References Cited

U.S. PATENT DOCUMENTS

| | | | | |
|---|---|---|---|---|
| 3,158,887 | A | 12/1964 | Kanbar et al. | 15/104 |
| 3,343,194 | A | 9/1967 | Ramelson | 15/104 |
| 3,742,547 | A | 7/1973 | Sohmer | 15/104 A |
| 3,958,292 | A | 5/1976 | Powell | 15/104 A |
| 4,427,726 | A | 1/1984 | Wolfrum | 428/43 |
| D324,779 | S | 3/1992 | Ueda | D4/137 |
| 5,940,921 | A | 8/1999 | Wood et al. | 15/104.002 |
| 6,014,788 | A | 1/2000 | Jaffri | 15/104.002 |
| 6,405,403 | B1 | 6/2002 | McKay | 15/228 |
| D463,134 | S | 9/2002 | Vosbikian | D4/122 |
| D484,703 | S | 1/2004 | Kim | D4/122 |
| 6,684,442 | B1 * | 2/2004 | Parker et al. | 12/146 B |
| 6,817,932 | B2 | 11/2004 | Furey | 451/358 |
| 2003/0039824 | A1 | 2/2003 | Aalbers | 428/343 |
| 2003/0089632 | A1 | 5/2003 | Jessen et al. | 206/389 |
| 2003/0209565 | A1 | 11/2003 | McKay | 222/192 |
| 2003/0228834 | A1 | 12/2003 | Furey | 451/358 |
| 2004/0052570 | A1 | 3/2004 | McKay | 401/219 |
| 2007/0017124 | A1 * | 1/2007 | Koo et al. | 36/59 R |

* cited by examiner

*Primary Examiner*—Marie Patterson
(74) *Attorney, Agent, or Firm*—Black Lowe & Graham PLLC

(57) ABSTRACT

This disclosure relates to a method of using a traction-enhancing device to enhance the traction between a sole of a shoe and a hard court athletic surface. The method includes rolling an adhesive roll of the traction-enhancing device against the sole of the shoe. The rolling process encourages the transfer of particulates from portions of the sole to the adhesive roll, where enough particulates are removed with a few back and forth rolls of the adhesive roll to at least slightly enhance the traction between the shoe sole and the athletic surface.

6 Claims, 7 Drawing Sheets

SHOE SOLE TRACTION-ENHANCING DEVICE

CROSS-REFERENCE TO RELATED APPLICATION

This application claims the benefit under 35 U.S.C. § 119(e) of U.S. Provisional Patent Application No. 60/521,859, filed Jul. 13, 2004. This provisional application is incorporated herein by reference in its entirety.

BACKGROUND OF THE INVENTION

1. Field of the Invention

This disclosure generally relates to a device for enhancing the traction on a footwear sole, such as the sole of an athletic shoe.

2. Description of the Related Art

In many athletic activities played on a hard playing surface, such as a basketball, tennis or volleyball court, the players are often required to quickly stop, pivot, or reverse direction. Sport courts, however, are prone to collect clothing fibers, dust, and many other forms of micro-debris from a variety of places, including the players, the fans, or even the entertainers (e.g., cheerleaders). The micro-debris can and often does accumulate on the sole of a player's shoe, and may eventually lead to a reduction or loss of traction between the player's shoe sole and the court surface.

One debris-removing device for shoes is a fixed-mounted brush for cleaning dirt and grass from, for example, the cleats of a golf shoe. Yet another debris-removing device for shoes is a tacky mat placed at an entryway of an operating (e.g., sterile) room to remove micro-debris and/or dirt from the shoes worn by surgeons, nurses, and/or other hospital staff members.

Finally, another type of debris-removing device for shoes is a tacky mat called the FASTBRAKE® Sports Mat, which is made by JTC Services, Inc. of Minnesota <http://www-.fast-brake.com>. The FASTBRAKE® Sports Mat includes a number of tacky sheets, approximately twenty to forty, stacked on a base having an integrated handle for transporting the base. The FASTBRAKE® Sports Mat comes in sizes of 6"×14", 15"×18", and 26"×26". A similar system is called the SLIPP-NOTT® traction system, which comprises a base and a mat, and is manufactured by Slipp-Nott Corporation of California. The base includes a rubber backing that protects the floor and holds the base in place. The mat comprises a replaceable set of tacky sheets supported on the base. Used sheets are peeled off from the mat to expose a new, clean sheet.

One drawback of the aforementioned mats is the difficulty associated with locating and/or positioning the mats in a readily accessible, but non-crowded area. Further, once the mats are placed on the floor, they are susceptible to being stepped on by people other than the players. During high traffic conditions, the tacky sheets comprising the mat become quickly used and must be replenished often.

Although the above debris-removing devices are available for removing micro-debris and/or dirt from shoes, there remains a need for a robust, easily maneuverable device that has a small footprint and can be used by a player while courtside to clean the soles of the players' shoes and thus enhance the traction between the soles and the athletic playing surface.

SUMMARY OF THE INVENTION

This invention relates to methods of using a traction-enhancing device to enhance the traction between a sole of a shoe and an athletic playing surface. The method includes rolling an adhesive roll of the traction-enhancing device against the sole of the shoe. The rolling process encourages the transfer of particulates from portions of the sole to the adhesive roll, where enough particulates are removed with a few back and forth rolls of the adhesive roll to at least slightly enhance the traction between the shoe sole and the athletic surface.

In one aspect, a method for enhancing traction between a shoe sole and an athletic surface includes placing a portion of an adhesive roll into contact with the shoe sole. The adhesive roll includes a plurality of removable adhesive sheets and is configured to roll in response to movement of the shoe sole. The contact between the adhesive roll and the shoe sole causes at least some particulates to be transferred from portions of the shoe sole to the adhesive roll to at least slightly enhance the traction between the shoe sole and the athletic surface.

The present invention is also directed toward devices and systems for improving the traction between the shoe and the athletic surface.

BRIEF DESCRIPTION OF THE DRAWINGS

In the drawings, identical reference numbers identify similar elements or acts. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

DETAILED DESCRIPTION OF THE INVENTION

In the following description, certain specific details are set forth in order to provide a thorough understanding of various embodiments of the invention. However, one skilled in the art will understand that the invention may be practiced without these details. In other instances, well-known structures associated with shoes and the assembly thereof have not necessarily been shown or described in detail to avoid unnecessarily obscuring descriptions of the embodiments of the invention.

Unless the context requires otherwise, throughout the specification and claims which follow, the word "comprise" and variations thereof, such as, "comprises" and "comprising" are to be construed in an open, inclusive sense, that is as "including, but not limited to."

The headings provided herein are for convenience only and do not interpret the scope or meaning of the claimed invention.

The following description relates generally to a device for cleaning the sole of an athletic shoe and enhancing the traction between the sole and an athletic playing surface such as a basketball court, tennis court, volleyball court, or the like.

Figure 1:
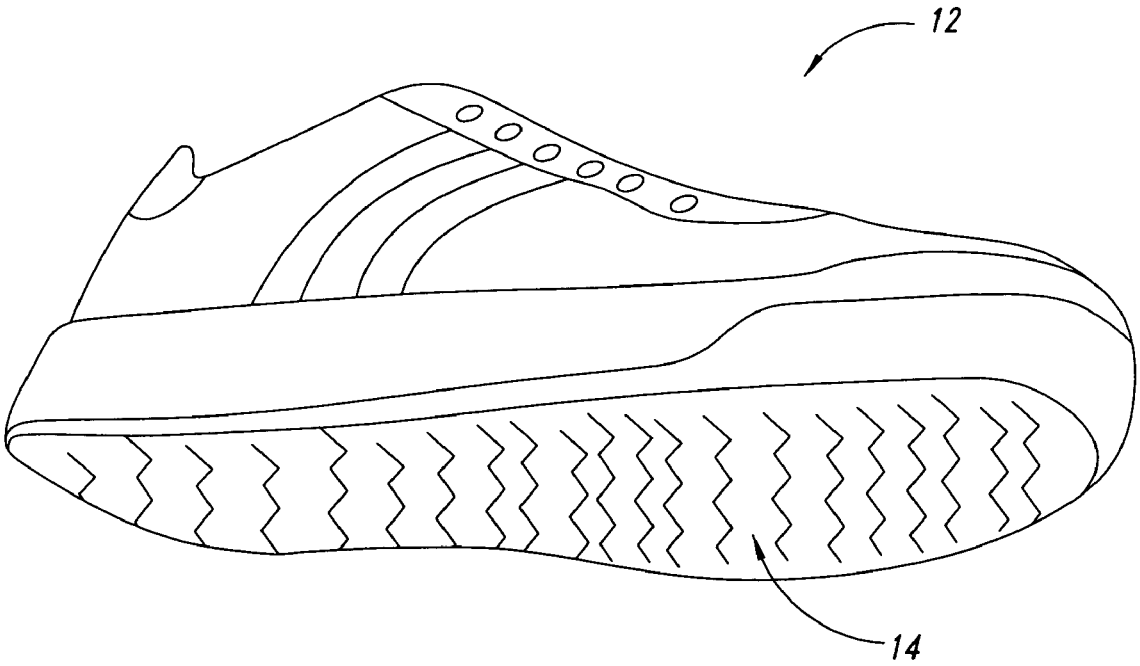
FIG. 1 is an isometric view of a shoe and a traction-enhancing device according to one illustrated embodiment.
Figure 1:
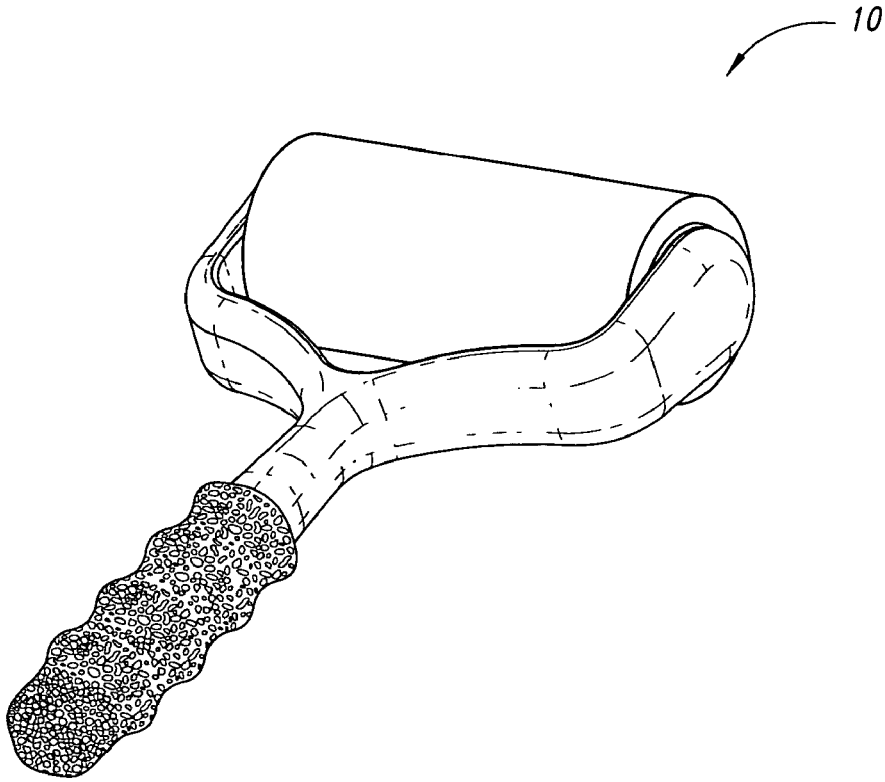

FIG. 1 shows one particular embodiment of a traction-enhancing device 10 and an athletic shoe 12 having a sole 14. The shoe 12 is depicted as a basketball shoe 12, but it is understood that the shoe 12 may be any suitable type of shoe. The sole 14 is typically made from a rubber or rubber-like material and generally has a fairly non-aggressive tread pattern (e.g., generally smooth with only small ridges and bumps to achieve a large amount of surface area).

Figure 2:
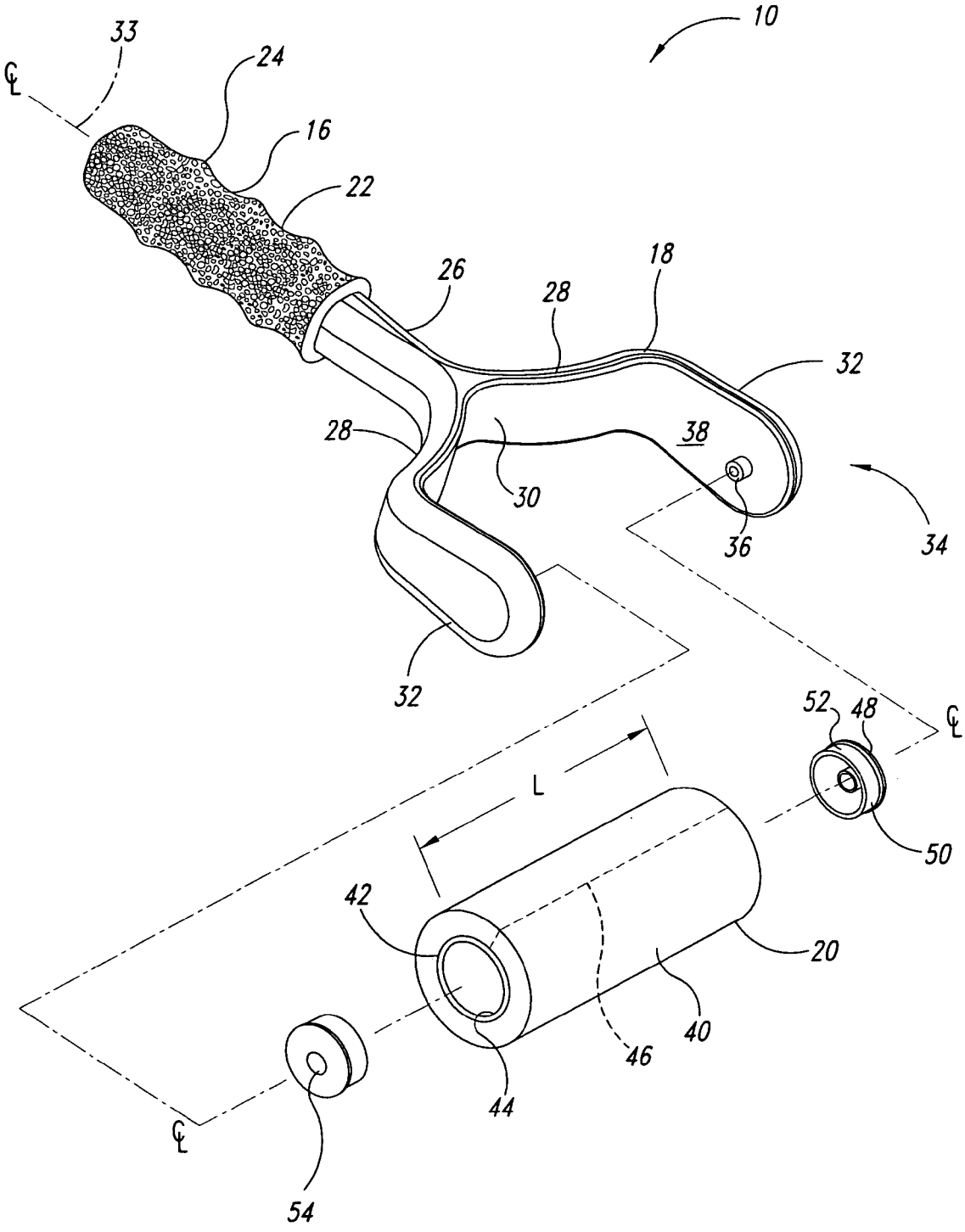
FIG. 2 is an exploded, isometric view of the traction-enhancing device of FIG. 1.

FIG. 2 shows the traction-enhancing device 10 having a handle 16, a frame 18, and a roller 20 rotationally coupleable to the frame. The handle 16 can be made from a soft, over-molded thermoplastic elastomer such as SANTOPRENE®, available from the Monsanto Corporation, or TEKBOND®, available from the Teknor Apex Corporation, or other suitable materials. The durometer range of the illustrated handle 16 is about 20-100 shore A, and preferably in the range of about 40-60 shore A. This range permits the handle 16 to have some amount of resiliency and be easily gripped.

The handle 16 can have a number of recessed regions 22, each being adjacent to a raised region 24, and these regions can be configured to make the handle generally conform to a human hand. In addition, the recessed and raised regions 22, 24 can help keep the handle 16 from slipping in the user's hand while being held or used.

The frame 18 can include a first portion, or shaft, 26 extending according to the illustrated embodiment. The handle 16 can be molded around the first portion 26. Second portions 28, or a yoke, can extend from the first portion 26, and can generally form a V-shape region 30. An arm 32 can extend from each of the respective second portions 28 in a direction that is generally parallel to a longitudinal axis 33 of the first portion 26. The second portions 28 and the arms 32 can be oppositely and biasly cantilevered from the first portion 26. The illustrated arms 32 are configured to naturally be in a first position 34, in which the arms 32 are generally parallel to one another. However, because the illustrated arms 32 are cantilevered from the first portion 26, the arms 32 can be forcibly moved apart from each other to allow the user to insert and/or remove the roller 20. Each of the arms 32 can include a spindle 36 that extends from a first surface 38 of the arm in a direction generally toward the opposing arm 32. The frame 18 can be a monolithic and/or molded part made from a hard plastic material according to the illustrated embodiment.

The roller 20 comprises a plurality of tacky sheets 40 arranged on an inner cylinder 42 having an inner diameter 44. The tacky sheets 40 can have both a tacky surface and a non-tacky surface. The tacky surface faces radially outward with respect to the inner cylinder 42. A single, radial cut 46 extending through at least a majority of the sheets 40 determines the length of each tacky sheet 40. The width of each tacky sheet approximately corresponds to a longitudinal length "L" of the inner cylinder 42.

Hubs 48 can be used to rotationally couple the roller 20 to the arms 32 of the frame 18. The illustrated hubs 48 have a first diameter 50 sized to be closely received by the inner diameter 44 of the inner cylinder 42, and an opening 54 sized to be closely received by the respective spindles 36 protruding from the arms 32 of the frame 18. In one embodiment, rotation of the roller 20 with respect to the arms 32 takes place between the spindles 36 and the openings 54. In another embodiment, the rotation takes place between the surface 52 of the hubs 48 and the inner diameter 44 of the inner cylinder 42.

In one exemplary operation of the traction-enhancing device 10, the players of a basketball team use the device 10 to keep the soles 14 of their shoes 12 substantially free of debris, which in turn allows more surface area of the soles 14 to contact the playing surface of the basketball court. Micro-debris on the sole 14 of a shoe 12 decreases the coefficient of friction between the sole 14, as a whole, and the playing surface, making it easier for a player to slip on the playing surface.

The traction-enhancing device 10 can be kept under a chair or elsewhere that does not take up any floor space. When a player wants to clean the soles 14 of his/her shoes 12, the player can grab the traction-enhancing device 10 and place the roller 18 of the device 10 into contact with the shoe sole. A quick, easy back and forth motion from the heel to the toe, and if desired, then from the toe to the heel of the shoe 14 causes the roller 20 to roll and remove a substantial amount of micro-debris. Depending on how coated the sole 14 of the shoe is with micro-debris, a number of back and forth motions may be needed to sufficiently clean the sole 14 of the shoe 12. It is understood and appreciated that the tacky surface of the roller 20 is sufficiently tacky to remove micro-debris and may or may not leave a tacky residue on the shoe sole 14. However, it is appreciated that tackier sheets 40 could be used, if desired, that would actually transfer some amount of adhesive to the soles 14. It is further understood that the roller 20 may not make contact with the entire surface of the sole 14 because of the tread pattern on the sole 14.

Figure 3:
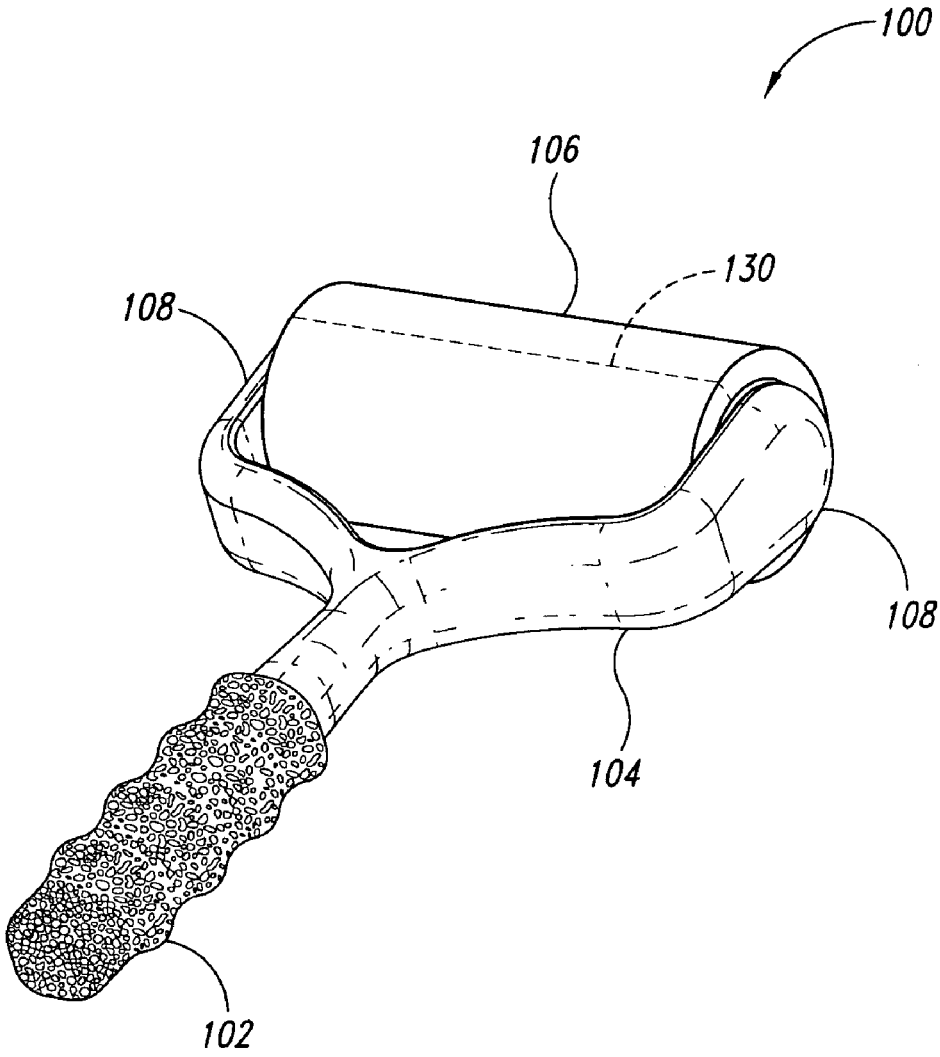
FIG. 3 is an isometric view of a traction-enhancing device according to another illustrated embodiment.
Figure 4:
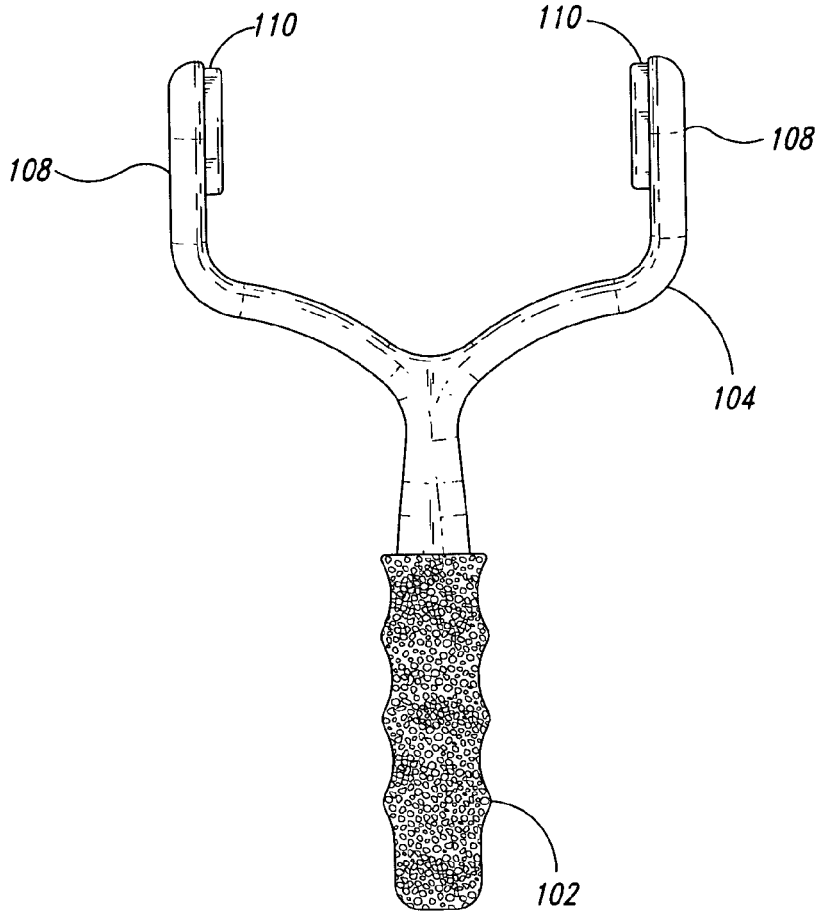
FIG. 4 is a plan view of a handle of the traction-enhancing device of FIG. 3.

FIGS. 3 and 4 show a traction-enhancing device 100 according to another illustrated embodiment. Similar to the previous embodiment, the traction-enhancing device 100 includes a handle 102, a frame 104, and a roller 106. Instead of the intermediate hubs described above, the roller 106 is directly coupled to a pair of arms 108. Each arm 108 includes a large spindle 110 (FIG. 4) that is sized to be received by an inner cylinder of the roller 106. In the illustrated embodiment, the fit between the spindles 110 and the roller 106 is such that the rotation of the roller takes place between the inner cylinder of the roller and the large spindles. Further, the large spindles 110 can be integrally formed with the arms 108 or can be separately attached thereto. In one embodiment, the inner cylinder of the roller 106 is made from a hard plastic material so that the inner cylinder can be easily rotated with respect to the large spindles 110.

Figure 5:
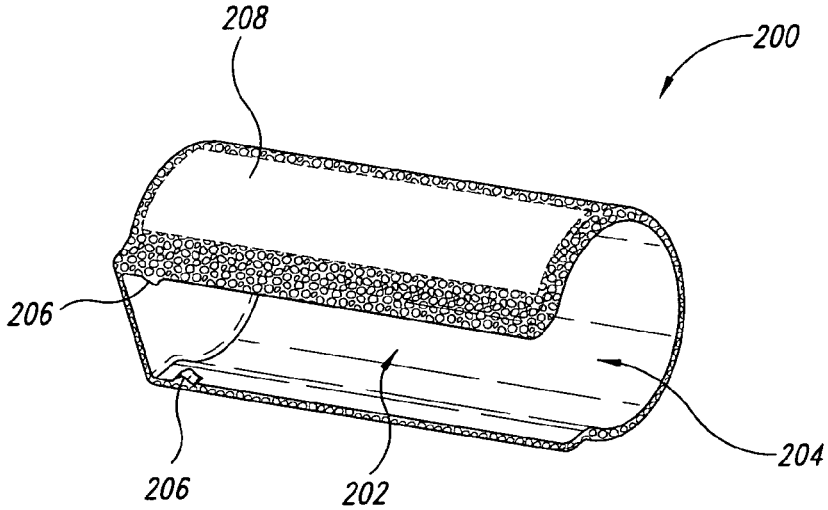
FIG. 5 is an isometric view of a cover for the traction-enhancing device of FIG. 3, according to one illustrated embodiment.

FIG. 5 shows one particular cover 200 for covering the roller of the traction-enhancing device. The cover 200 helps prevent unwanted airborne or other particulates from accumulating on the tacky surface of the roller when the traction-enhancing device is not in use. The cover 200 has a slot 202 sized to fit over the arms of the frame, and has an opening 204 sized to fit over the roller. The cover further includes protuberances 206 that permit the cover 200 to be detachably, but securely coupled with the frame of the traction-enhancing device. A region 208 on the cover 200 can be used for the placement of a brand name, a team logo, or other text and/or graphic elements.

Figure 6:
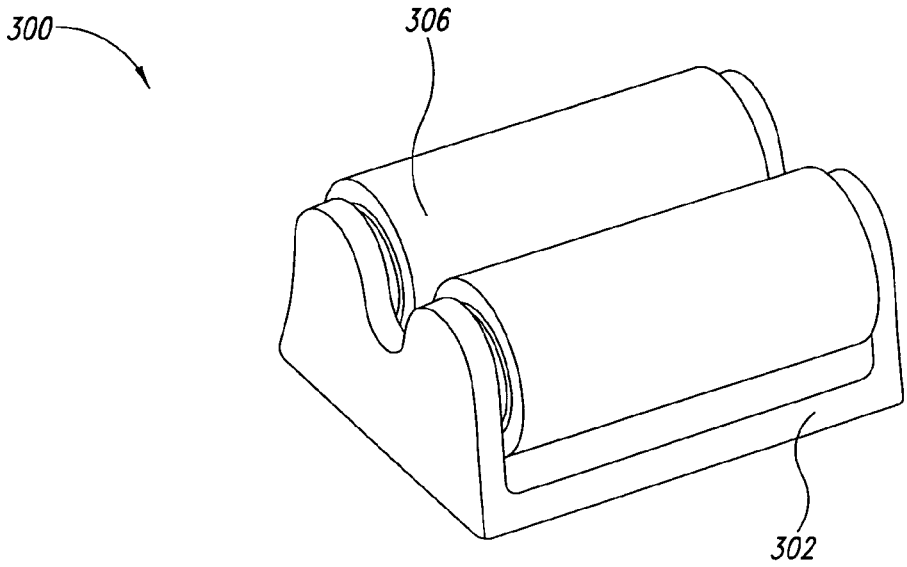
FIG. 6 is an isometric view of the traction-enhancing device of FIG. 6.
Figure 7:
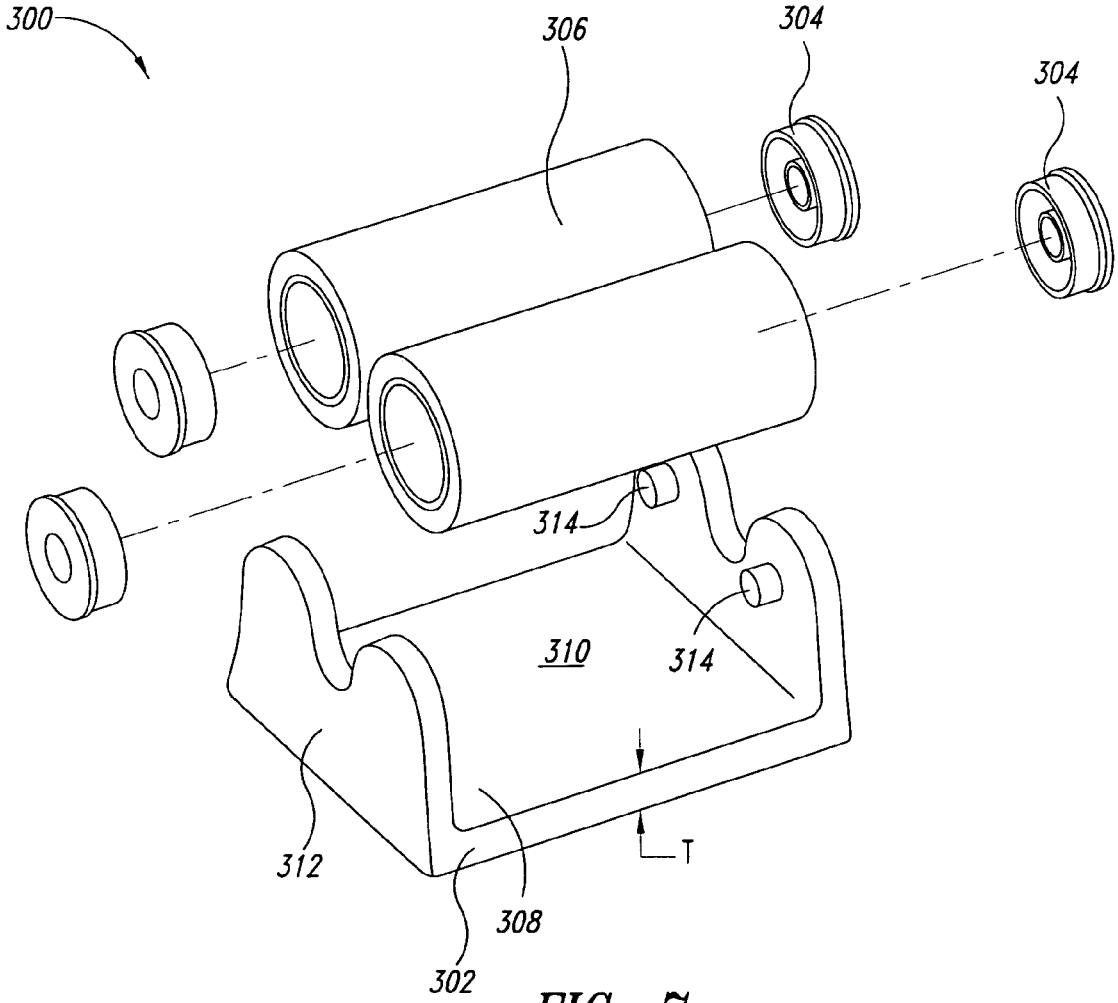
FIG. 7 is an exploded isometric view of a traction-enhancing device according to yet another illustrated embodiment.

FIGS. 6 and 7 show a floor-supported traction-enhancing device 300 having a frame 302, hubs 304, and rollers 306. The hubs 304 and the rollers 306 are similar to the respective hubs and rollers described above.

The illustrated frame 302 has a bottom section 308 having a thickness "T." The thickness T can be uniform or can be variable over the width of the device 300. In one embodiment, the thickness T varies to make the bottom section 308 a ramp, such that the first surface 310 of the bottom section 308 is at an angle with respect to the court surface when the device 300 is placed on the court surface.

A pair of vertical extension members 312 extend from the bottom section 308. The vertical extension members 312 each include spindles 314 to rotationally couple the rollers 306 to the frame 302. In addition, the vertical extension members 312 can be biasly cantilevered from the bottom section 308 so that the members 312 can be forcibly moved apart from each other to insert and/or remove the rollers 306.

Figure 8:
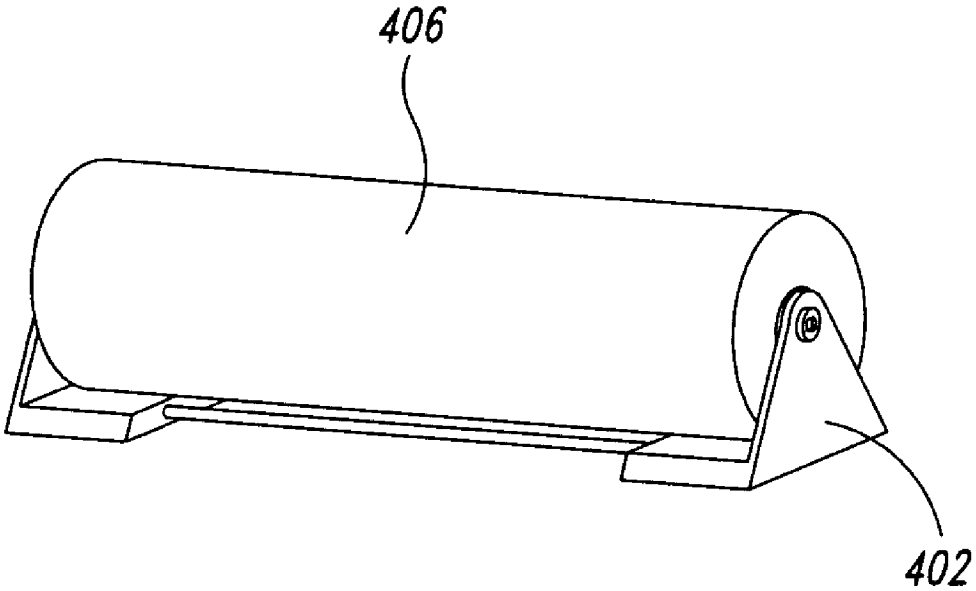
FIG. 8 is an isometric view of the traction-enhancing device of FIG. 8.
Figure 9:
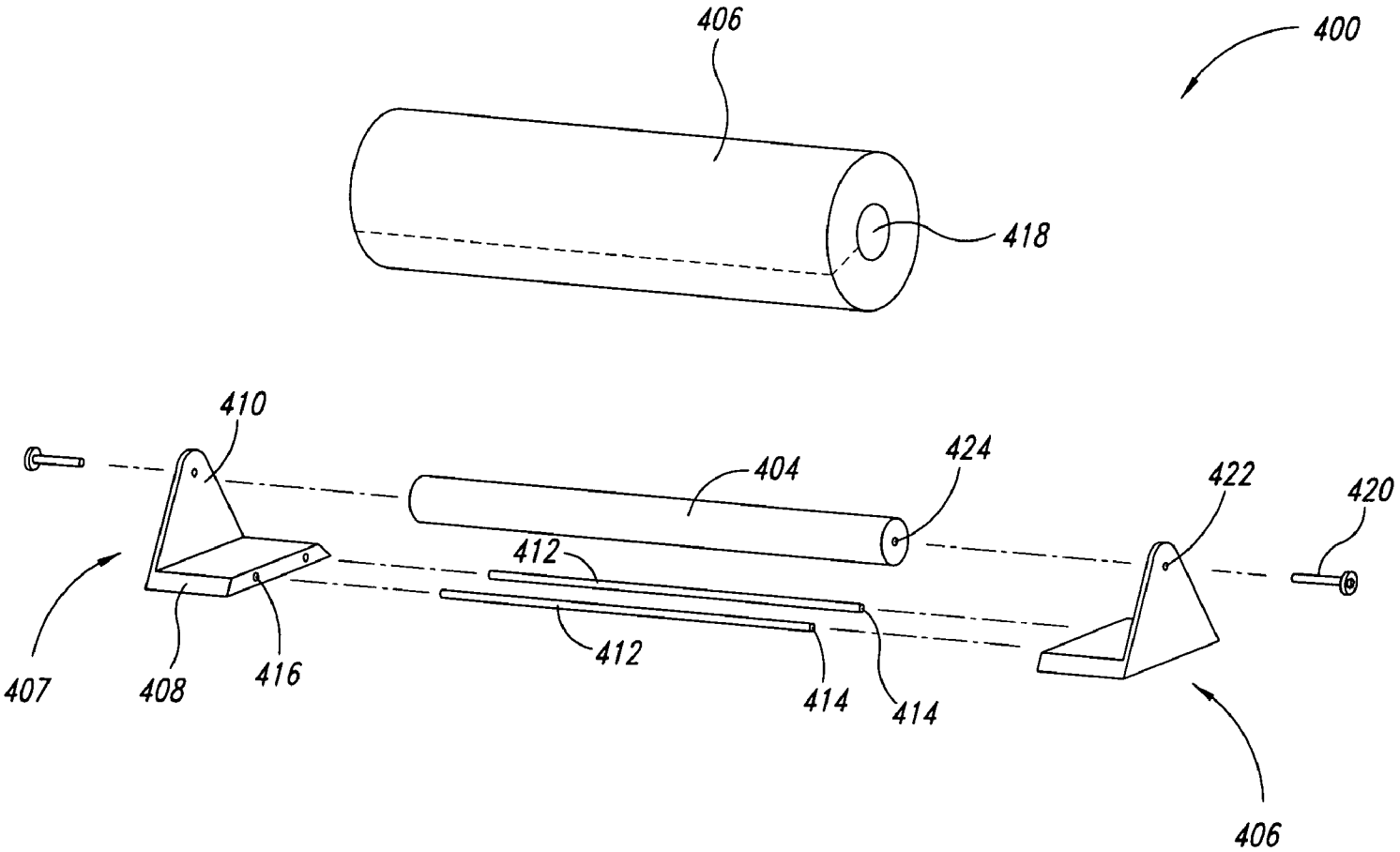
FIG. 9 is an exploded isometric view of a traction-enhancing device according to still another illustrated embodiment.

FIGS. 8 and 9 show a traction-enhancing device 400 having a frame 402, an axle 404, and a roller 406. The roller 406 is similar to the roller described in the first embodiment and in the interest of brevity will not be described in any further detail.

The frame 402 includes two opposing brackets 407, each bracket having a base 408 and a vertical flange 410. The base 408 is dimensioned to make the device 400 sufficiently stable in operation, for example when the force of a shoe is applied to the roller 406. One or more rods 412 can be disposed between the respective brackets 407. Each end region 414 of each rod 412 can be received in an opening 416 in each respective base 408. The illustrated rods 412 are closely received by the openings 416 and may require some amount of force to be inserted into the openings 416. However in one embodiment, the rods 412 are separable from the bases 408 during disassembly of the device 400.

The axle 404 extends through a passage 418 in the roller 406. The axle 404 can be pin-connected to the vertical flanges 410 of the brackets 407. The illustrated pins 420 are inserted through an opening 422 in the vertical flanges 410 and further inserted into a respective end region 424 of the axle 404. In one embodiment, the rotation of the roller 406 relative to the frame 402 occurs between the pins 420 and the vertical flanges 410 of the frame 420. In this embodiment, bushings (not shown) may be inserted into the openings 422 of the vertical flanges 410. In another embodiment, the rotation of the roller 406 relative to the frame 402 occurs between the pins 420 and the axle 404. Likewise, bushings (not shown) may be inserted into the end regions 424 of the axle 404.

The various embodiments described above can be combined to provide further embodiments. All of the above U.S. patents, patent applications and publications referred to in this specification are incorporated herein by reference. Aspects can be modified, if necessary, to employ devices, features, and concepts of the various patents, applications and publications to provide yet further embodiments.

These and other changes can be made in light of the above detailed description. In general, in the following claims, the terms used should not be construed to limit the invention to the specific embodiments disclosed in the specification and the claims, but should be construed to include all types of adhesive roller devices that operate in accordance with the claims. Accordingly, the invention is not limited by the disclosure, but instead its scope is to be determined entirely by the following claims.

What is claimed is:

1. A method for enhancing traction between a sole of a shoe and an athletic surface, the method comprising:

placing a portion of an adhesive roll of a traction-enhancing device into contact with the sole of the shoe, the adhesive roll configured to roll relative to the sole and the traction-enhancing device;

rolling the adhesive roll across the sole while maintaining the adhesive roll in contact with at least a portion of the sole; and transferring at least some particulates from portions of the sole to the adhesive roll during rolling of the adhesive roll, the transfer of at least some of the particulates being sufficient to at least slightly enhance traction between the sole of the shoe and the athletic surface.

2. The method of claim 1 wherein placing the portion of the adhesive roll of the traction-enhancing device into contact with the sole of the shoe includes placing a hand-held unit into contact with the sole, the hand-held unit comprising a handle, a frame coupled to the handle, and an adhesive roll rotationally coupled to the frame.

3. The method of claim 1 wherein placing the portion of the adhesive roll of the traction-enhancing device into contact with the sole of the shoe includes placing the traction-enhancing device onto the floor, placing the sole into contact with the adhesive roll, the floor-supported traction-enhancing device comprising a base, a spindle coupled to the base, and an adhesive roll rotationally mounted on the spindle.

4. The method of claim 1 wherein rolling the adhesive roll comprises moving the shoe while the sole is in contact with the adhesive roll.

5. The method of claim 1, further comprising:

removing a first adhesive sheet from the adhesive roll to expose a second adhesive sheet.

6. The method of claim 1, further comprising:

removing a cover to expose the adhesive roll.

* * * * *